United States Patent [19]

Aigner

[11] 4,124,832

[45] Nov. 7, 1978

[54] ELECTROMAGNETIC RELAY

[75] Inventor: Georg Aigner, Ebersberg, Germany

[73] Assignee: Siemens Aktiengesellschaft, Berlin & Munich, Germany

[21] Appl. No.: 768,784

[22] Filed: Feb. 15, 1977

[30] Foreign Application Priority Data

Feb. 20, 1976 [DE] Fed. Rep. of Germany ..... 2607048

[51] Int. Cl.[2] ..... H01H 50/58

[52] U.S. Cl. ..... 335/128; 335/135

[58] Field of Search ..... 335/135, 128, 129, 203, 335/127, 200, 193, 194

[56] References Cited

U.S. PATENT DOCUMENTS 3,501,720 3/1970 Mathys ..... 335/135

*Primary Examiner*—Harold Broome

*Attorney, Agent, or Firm*—Hill, Gross, Simpson, Van Santen, Steadman, Chiara & Simpson

[57] ABSTRACT

An electromechanical switching or relay apparatus wherein an armature moves a relay contact by means of an interposed rigid slide member having opposite ends contacting respectively the armature and a portion of the contact means. The rigid member is angled with respect to one of the armature or relay portion so as to impose a relative rubbing movement during cycling of the system.

1 Claim, 2 Drawing Figures

ELECTROMAGNETIC RELAY

BACKGROUND OF THE INVENTION

1. Field of the Invention

This invention relates to an electromagnetic device and more particularly to automatic relays and the like.

2. Prior Art

Electromatic relays which interpose a rigid slide member mounted in a slide guide between an armature and one or more contact springs of a relay assembly are known.

For various reasons, in electromagnetic relays of the above described type, the armature is often constructed to have relatively friction free movement. In this manner, designers have attempted to achieve the lowest possible actuation power requirements while simultaneously achieving the highest possible switching speed. Additionally, by reducing friction, it is possible to reduce contamination of the relay contacts by reducing abrasion caused contaminents. The result has been to provide an increased life span.

However, in certain cases, the use of extremely low friction armature mounting designs leads to undesirably severe contact chattering which can occur when the armature and the rigid member return together to a rest position after the switching movement has occurred. Such chatter is not caused solely by the recall of the armature but, to a certain extent, is caused or added to by natural oscillations of the slide and the relay contact spring.

It has been known to damp such oscillation movement of the armature by means of interposed partially elastic stops. Such a construction is shown in German Auslegeschrift No. 1,917,896. In other embodiments, friction springs have been provided with the springs rubbing directly on the relay contact spring to reduce or nullify any undesired excess kenetic energy. See British Pat. No. 1,142,904 for such a construction.

The known chatter damping devices have a common disadvantage in that they require additional parts and assembly operations. Additionally when used in relays which utilize a rigid slide carried member, such devices are of reduced utility in that they fail to sufficiently dampen chatter caused by or attributable to the mass of the rigid member.

It would therefore be an advance in the art to provide a method of reducing or eliminating chatter in electromagnetic relays of the type having a rigid slide member interposed and guided between an armature and a portion of the relay for transmitting the armature movement to the relay.

SUMMARY OF THE INVENTION

It is, therefore, a primary object of this invention to produce a relay of the type above described in which a rigid member slide mounted in a slide guide is associated with effective damping means reducing or eliminating undesired chatter and to accomplish this without the necessity of additional parts or assembly operations.

According to the teachings of this invention, I have achieved the above objective by arranging the slide guided rigid member and its associated slide guide at an oblique angle to the direction of movement of the armature arm or at such an angle to the direction of movement of the contact spring driven by the rigid member or at such an angle with respect to both the armature arm and the contact spring.

Thus, in this invention, it is provided that the rigid member contact slide will strike obliquely against the armature and/or respectively, against the contact spring. This differs from conventional relays wherein it was customary to have the rigid slide member strike squarely, or as perpendicularly as possible against the armature arm. During switch movement the oblique angled rigid slide member will rub not only on the armature but also on the contact spring. This rubbing effectively reduces or suppresses undesired chatter. By properly selecting the angulation of the rigid member vis-a-vis the armature, and/or the contact spring, as the case may be, the amount of friction can be varied thereby allowing preselection of a desired friction quantity. In this manner, depending upon the relay construction, it is possible to vary the chatter damping ability of this system in such a way as to precisely suppress the chatter of the particular relay system involved without requiring unnecessarily high switch actuating forces to be produced.

Further, the chatter damping construction of this invention does not require any additional constructional expenditures particularly in connection with those relay assemblies where a slide guide would otherwise be provided for the slide.

In one particular embodiment of the invention the oblique slide guide or guides can be injection molded and be formed in one piece with the relay housing. In this manner, the only expense necessary for the implementation of this invention is the production of injection molding dies and thereafter no additional step or part is required from those which have heretofore been used.

Further, in the preferred embodiment, the rigid member slide is advantageously positioned in the slide guide with a degree of play. Thus the slide can become cocked or somewhat angled with respect to the guide itself. This will generally occur at the beginning of switching movement therefore providing that the desired dampening friction will occur at the end of the switching movement, i.e. at that point in time where it is most advantageously desired for nullifying the kinetic energy of the relay spring.

In a further modification of the invention the desired coefficient of friction can be produced or enhanced by means of a special coating of the rubbing faces between the rigid member on the one hand and the armature arm on the other hand or respectively, the moving portion of the contact spring on the one hand and the slide on the other hand. It is desired, if a friction coating is provided, that the coating be judiciously chosen such that the utilized material will produce the desired friction without creating abrasion particles which would otherwise contaminate the contacts.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
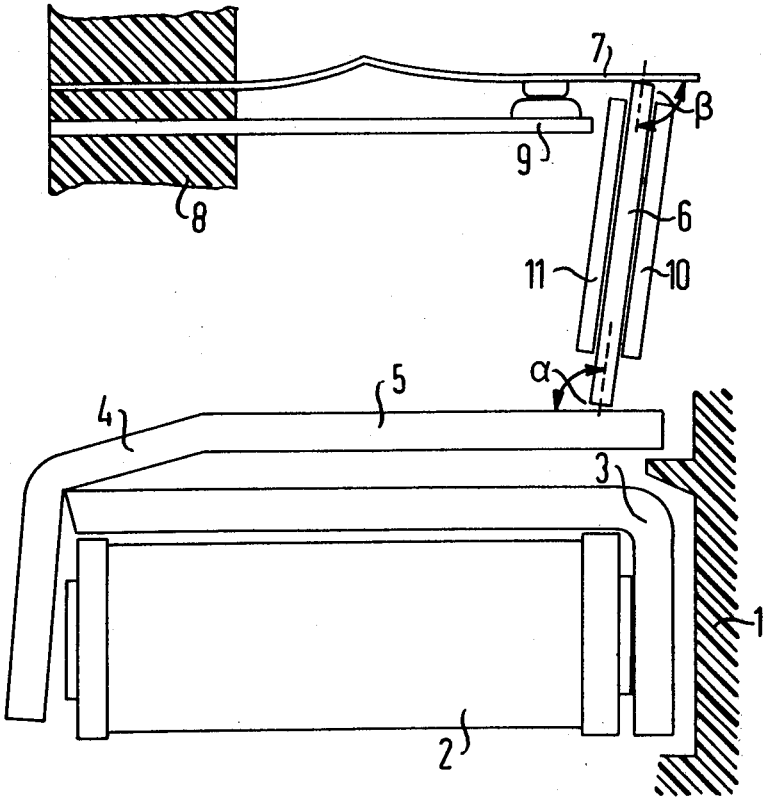
FIG. 1 is a fragmentary vastly enlarged partially sectional elevational view of portions of a relay constructed according to this invention.

As illustrated in FIG. 1, a relay assembly is equipped with a housing 1, 8 which in the illustration is shown only allusively. Within the housing a magnet system including a coil 2 and a yoke 3 is positioned. An angled armature arm 4 is supported on and pivotable on an edge of the yoke and includes a shank portion 5. The shank portion contacts one end of a slide 6 which is a rigid member. The opposite end of the slide actuates a contact spring 7 which forms part of a relay fixed in the portion 8 of the housing and including an opposed contact arm 9 which, in some instances may also be a spring arm. A slide guide may be received in the housing or may be formed integrally with portions of the housing wall and includes spaced apart side walls 10 and 11 defining a slide receiving channel therebetween. The slide guide walls 10 and 11, and the slide 6 are positioned with respect to the relay spring 7 and the armature arm 5 such that the slide is disposed at an angle thereto. The angle $\alpha$ or respectively angle $\beta$ is other than 90°.

Figure 2:
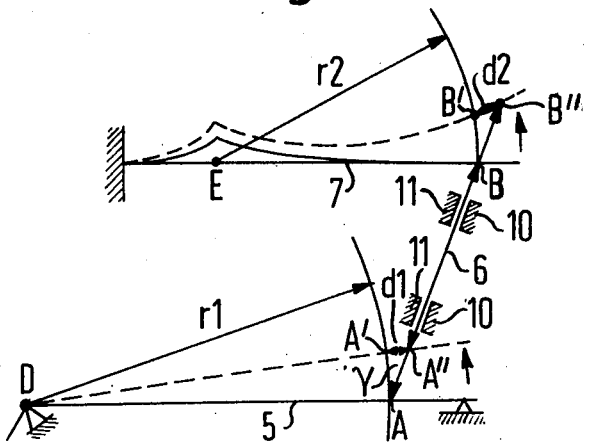
FIG. 2 is a diagrammatic drawing of the relay of FIG. 1.

FIG. 2 diagrammatically illustrates the effect of angulation of the slide member with respect to the armature and/or the relay spring. In the unactuated rest position, the slide 6 will contact the armature portion 5 at point A. Since the armature is pivoted at point D, point A will move, during actuation of the armature, along a circle having a radius *r*1. On the other hand, because of the confinement of the slide 6 in the slide guides 10 and 11, the slide can move only longitudinally at the angle $\gamma$ with the circle at point A. Since, at the furtherest point of movement of the armature during switching movement, the point A will have moved to point A′ while the end of the slide 6 will have moved to point A″, the slide 6 must, of necessity, therefore move the distance *d*1 on the armature. The distance *d*1 therefore represents a friction path.

A similar condition exists with respect to the contact spring 7 and its contact with the slide 6. The anchored contact spring has a rest position with the slide to spring contact being at point B. During actuation of the switch, point B will move along an arc having a radius *r*2 and a center at approximately E to point B′. Since the end of the slide 6 is confined for longitudinal movement it will move to point B″ at the same time. This once again leaves a friction path *d*2 which is the distance between B′ and B″. By proper selection of the angle $\gamma$ the friction paths, therefore the amount of damping of the chatter can be chosen.

By dimensioning the distance between the side walls 10 and 11 of the guide with respect to thickness of the slide 6 such that the slide is losely received in the guide, it will be assured that the slide can tilt with respect to the guide walls. This tilt will occur at the beginning of the switching movement thus delaying onset of the friction path movement until a later point towards the conclusion of the switching movement when it is most desired.

According to this invention, where desired, the ends of the slide 6 can, when needed, be coated with a friction increasing surface. Preferably the surface will be such that it will not give off abrasion particles during usage and will have a defined coefficient of friction.

It is to be understood that although the illustration above is discussed in connection with a single relay switch, the invention is clearly applicable to relays having multiple contact switches, particularly when the contact switches are arranged parallel. In such an instance the slide can undergo chatter damping frictional movement with respect to each of the contacted contact springs. In some instances this can be accomplished by means of formed cross bars.

It will therefore be seen from the above that my invention provides an electromechanical relay system wherein an oscillation or chatter damping is accomplished by means of angling the relay actuating slide member with respect to the actuating armature and/or with respect to the contact point of the relay spring. The angulation is preferably opposite the arc direction of movement of the armature or the contact spring and the degree of angulation and the material of the slide or coatings thereon can be chosen so as to provide a specific coefficient to friction and friction path length so as to allow predetermination of a desired damping effect for each type of relay.

Damping occurs, according to this invention, due to the creation of a movement path between the slide end contacting the armature and/or the spring.

Although the teachings of my invention have herein been discussed with reference to specific theories and embodiments, it is to be understood that these are by way of illustration only and that others may wish to utilize my invention in different designs or applications.

I claim as my invention

1. In an electromagnetic relay having at least one contact spring disposed in a housing and movable between switching positions by movement of a slide member acted upon by movement of a relay associated armature with one end of the slide member in contact with the contact spring and the other end of the slide member in contact with the armature and the slide member guided for movement in a guide, the improvement of angling the slide member with respect to the armature and contact spring, the angle chosen such that movement of the armature and the contact spring during switching causes the contacting ends of the slide to move relative to the armature and contact spring while maintaining contact with the armature and contact spring whereby a friction movement path exists between the end of the slide and the armature and contact spring, the slide being freely received in a slide guide and being capable of tilting therein providing a friction force between the slide and side walls of the slide guide, the angle being other than 90°, the angle being maintained in relation to the armature and contact spring in every switching position of the relay.

* * * * *